US010443983B2

(12) United States Patent
Hamm et al.

(10) Patent No.: US 10,443,983 B2
(45) Date of Patent: Oct. 15, 2019

(54) WINDAGE MECHANISM

(71) Applicants: Harold M. Hamm, Wisconsin Rapids, WI (US); Brian H. Hamm, Wisconsin Rapids, WI (US); Christopher A. Hamm, Wisconsin Rapids, WI (US)

(72) Inventors: Harold M. Hamm, Wisconsin Rapids, WI (US); Brian H. Hamm, Wisconsin Rapids, WI (US); Christopher A. Hamm, Wisconsin Rapids, WI (US)

( * ) Notice: Subject to any disclaimer, the term of this patent is extended or adjusted under 35 U.S.C. 154(b) by 0 days.

(21) Appl. No.: 16/253,335

(22) Filed: Jan. 22, 2019

(65) Prior Publication Data

US 2019/0265003 A1 Aug. 29, 2019

Related U.S. Application Data

(63) Continuation of application No. 15/908,126, filed on Feb. 28, 2018, now Pat. No. 10,190,851.

(51) Int. Cl.
*F41G 3/08* (2006.01)
*F41G 1/467* (2006.01)

(52) U.S. Cl.
CPC ..... *F41G 3/08* (2013.01); *F41G 1/467* (2013.01)

(58) Field of Classification Search
CPC ..... F41G 1/467; F41G 11/003; F41G 1/42; F41G 1/38; F41G 1/387; F41G 1/40; F41G 1/41; F41G 1/473
USPC ..... 33/265
See application file for complete search history.

(56) References Cited

U.S. PATENT DOCUMENTS

| | | | |
|---|---|---|---|
| 656,867 | A | 6/1900 | Tolman |
| 906,751 | A | 12/1908 | Swasey |
| 1,330,002 | A | 2/1920 | Price |
| 1,407,208 | A | 2/1922 | Cassel |
| 1,451,584 | A | 4/1923 | Mapes |
| 2,155,391 | A | 4/1939 | Arden |
| 2,545,454 | A | 3/1951 | Fredrickson |
| 2,671,966 | A | 3/1954 | Jacobsen |
| 2,975,780 | A | 3/1961 | Fisher |
| 2,980,097 | A | 4/1961 | Rothgery |
| 3,108,584 | A | 10/1963 | Coe |
| 3,224,427 | A | 12/1965 | Ernest |
| 3,285,237 | A | 11/1966 | Wolfe |
| 3,292,607 | A | 12/1966 | Hoyt, Jr. |
| 3,342,173 | A | 9/1967 | Ferguson |
| 3,455,027 | A | 7/1969 | Perkins |

(Continued)

FOREIGN PATENT DOCUMENTS

| | | |
|---|---|---|
| CN | 204666039 U | 9/2015 |
| DE | 191018847 | 8/1909 |

(Continued)

OTHER PUBLICATIONS http://www.hhasports.com/catalog/1/optimizer-lite-ultra/; website screenshot for the Optimizer Lite Ultra; Dec. 21, 2014.

(Continued)

*Primary Examiner* — Yaritza Guadalupe-McCall
(74) *Attorney, Agent, or Firm* — Shane Delsman; Godfrey & Kahn, S.C.

(57) ABSTRACT

A sight apparatus with a micro-adjustment mechanism and macro-adjustment mechanism, to laterally move a scope head and/or sight pin. The sight apparatus may also include adjustment mechanisms for pivotally adjusting the sight.

19 Claims, 12 Drawing Sheets

(56) References Cited

U.S. PATENT DOCUMENTS

| | | | |
|---|---|---|---|
| 3,504,659 | A | 4/1970 | Babington |
| 3,599,337 | A | 8/1971 | Snodgrass |
| 3,618,586 | A | 11/1971 | Current |
| 3,866,592 | A | 2/1975 | Carella |
| 3,935,854 | A | 2/1976 | Troncosco, Jr. |
| 4,071,014 | A | 1/1978 | Trotter |
| 4,133,334 | A | 1/1979 | Tone |
| 4,153,999 | A | 5/1979 | O'Steen |
| 4,226,095 | A | 10/1980 | Loken |
| 4,236,497 | A | 12/1980 | Troncoso, Jr. |
| 4,237,615 | A | 12/1980 | Bracknell |
| 4,287,868 | A | 9/1981 | Schiff |
| 4,291,664 | A | 9/1981 | Nishioka |
| 4,318,390 | A | 3/1982 | Trotter |
| 4,344,409 | A | 8/1982 | Barner |
| 4,351,311 | A | 9/1982 | Phares |
| 4,407,261 | A | 10/1983 | Elliott |
| 4,452,222 | A | 6/1984 | Quartino |
| 4,453,528 | A | 6/1984 | Eckert |
| 4,473,058 | A | 9/1984 | Terry |
| 4,492,214 | A | 1/1985 | Kielhoffer |
| 4,528,973 | A | 7/1985 | Rasmussen |
| 4,532,717 | A | 8/1985 | Watson |
| 4,542,732 | A | 9/1985 | Troncoso |
| 4,567,668 | A | 2/1986 | King |
| 4,579,101 | A | 4/1986 | Bateman, III |
| 4,598,688 | A | 7/1986 | Paul |
| 4,608,959 | A | 9/1986 | Seynaeve |
| 4,632,087 | A | 12/1986 | Cline |
| 4,660,289 | A | 4/1987 | Wilhide |
| 4,664,093 | A | 5/1987 | Nunemaker |
| 4,676,220 | A | 6/1987 | Pietraszek |
| 4,685,439 | A | 8/1987 | Cosentino, Jr. |
| 4,686,956 | A | 8/1987 | Troncoso, Jr. |
| 4,748,963 | A | 6/1988 | Troncoso et al. |
| 4,748,964 | A | 6/1988 | Troncoso, Jr. |
| 4,767,220 | A | 8/1988 | Kamp |
| 4,796,597 | A | 1/1989 | Farro |
| 4,803,971 | A | 2/1989 | Fletcher |
| 4,809,670 | A | 3/1989 | Simo |
| 4,827,895 | A | 5/1989 | Troncoso, Jr. |
| 4,829,974 | A | 5/1989 | Anderson |
| 4,838,237 | A | 6/1989 | Cliburn |
| 4,865,007 | A | 9/1989 | Saunders |
| 4,865,008 | A | 9/1989 | Troncoso |
| 4,879,988 | A | 11/1989 | Larson |
| 4,907,566 | A | 3/1990 | Klein |
| 4,949,699 | A | 8/1990 | Gerber |
| 4,953,521 | A | 9/1990 | Troncoso et al. |
| 4,961,265 | A | 10/1990 | Roberts |
| 5,009,215 | A | 4/1991 | Ludwig |
| 5,031,601 | A | 7/1991 | Gunter |
| 5,052,364 | A | 10/1991 | Martin et al. |
| 5,062,407 | A | 11/1991 | Newbold |
| 5,065,731 | A | 11/1991 | Smith |
| 5,070,855 | A | 12/1991 | Troncoso |
| 5,085,200 | A | 2/1992 | Horton-Corcoran |
| 5,092,052 | A | 3/1992 | Godsey |
| 5,092,053 | A | 3/1992 | Roberts |
| 5,095,884 | A | 3/1992 | Mertens |
| 5,117,803 | A | 6/1992 | Johnson |
| 5,117,804 | A | 6/1992 | Jorlov |
| 5,137,006 | A | 8/1992 | Gallops |
| 5,144,937 | A | 9/1992 | Colvin |
| 5,146,908 | A | 9/1992 | Larson |
| 5,148,796 | A | 9/1992 | Simo |
| 5,150,700 | A | 9/1992 | Troncoso |
| 5,161,514 | A | 11/1992 | Cary |
| 5,205,268 | A | 4/1993 | Savage |
| 5,213,090 | A | 5/1993 | Tone |
| 5,220,906 | A | 6/1993 | Choma |
| D337,145 | S | 7/1993 | Horton-Corcoran |
| 5,243,957 | A | 9/1993 | Neilson |
| 5,249,565 | A | 10/1993 | Saunders et al. |
| 5,251,606 | A | 10/1993 | Colvin |
| 5,265,584 | A | 11/1993 | Quiver |
| 5,274,941 | A | 1/1994 | Moore |
| 5,285,764 | A | 2/1994 | Mertens |
| 5,327,877 | A | 7/1994 | Shaw, III |
| 5,341,789 | A | 8/1994 | Paglia |
| 5,359,984 | A | 11/1994 | Simo |
| 5,365,912 | A | 11/1994 | Pittman |
| 5,372,119 | A | 12/1994 | Kidney |
| 5,394,858 | A | 3/1995 | Karolian |
| 5,400,539 | A | 3/1995 | Moore |
| 5,415,154 | A | 5/1995 | Angeloni |
| 5,428,915 | A | 7/1995 | King |
| 5,460,151 | A | 10/1995 | Hamilton, Jr. |
| 5,460,152 | A | 10/1995 | Specht |
| 5,465,491 | A | 11/1995 | Thell |
| 5,490,263 | A | 2/1996 | Hashemi |
| 5,490,492 | A | 2/1996 | Savage |
| 5,503,136 | A | 4/1996 | Tone |
| 5,511,317 | A | 4/1996 | Allen |
| 5,522,375 | A | 6/1996 | Simo |
| 5,526,799 | A | 6/1996 | Simo |
| 5,529,049 | A | 6/1996 | Antalosky |
| 5,553,597 | A | 9/1996 | Sparks |
| 5,601,069 | A | 2/1997 | Clark |
| 5,603,309 | A | 2/1997 | Sheliga |
| 5,606,961 | A | 3/1997 | Basik |
| 5,632,263 | A | 5/1997 | Sartain |
| 5,651,185 | A | 7/1997 | Vanderheyden |
| 5,697,356 | A | 12/1997 | Chappell |
| 5,718,215 | A | 2/1998 | Kenny |
| 5,722,381 | A | 3/1998 | Mizek |
| 5,743,245 | A | 4/1998 | Mizek |
| 5,896,849 | A | 4/1999 | Branthwaite |
| 5,915,369 | A | 6/1999 | Sheliga |
| 5,920,996 | A | 7/1999 | Hurckman |
| 5,944,005 | A | 8/1999 | Schiff |
| 5,960,779 | A | 10/1999 | Jessee |
| 5,975,069 | A | 11/1999 | Hamm |
| 6,035,842 | A | 3/2000 | Bradley |
| 6,044,832 | A | 4/2000 | Piersons, Jr. |
| 6,050,251 | A | 4/2000 | Harwath et al. |
| 6,058,919 | A | 5/2000 | Davis |
| 6,061,919 | A | 5/2000 | Reichert |
| 6,073,351 | A | 6/2000 | Barnett |
| 6,079,111 | A | 6/2000 | Wiliams |
| 6,082,348 | A | 7/2000 | Savage |
| 6,089,216 | A | 7/2000 | Harwath et al. |
| 6,102,020 | A | 8/2000 | Mizek |
| 6,161,532 | A | 12/2000 | Goff |
| 6,178,958 | B1 | 1/2001 | Gallops, Jr. |
| 6,178,959 | B1 | 1/2001 | Troncoso, Jr. |
| 6,196,455 | B1 | 3/2001 | Robinson |
| 6,202,635 | B1 | 3/2001 | Evans |
| 6,502,566 | B1 | 1/2003 | Achkar |
| RE38,096 | E | 4/2003 | Branthwaite |
| 6,561,174 | B1 | 5/2003 | Afshari |
| 6,571,785 | B1 | 6/2003 | Choma |
| 6,591,538 | B2 | 7/2003 | Holler |
| 6,595,195 | B1 | 7/2003 | Barner |
| 6,598,333 | B1 | 7/2003 | Randazzo |
| 6,609,306 | B2 | 8/2003 | Johnson |
| 6,615,813 | B1 | 9/2003 | Troncoso, Jr. |
| 6,634,349 | B2 | 10/2003 | Mizek |
| 6,648,871 | B2 | 11/2003 | Kusibojoska et al. |
| 6,651,355 | B2 | 11/2003 | Byrd |
| 6,651,641 | B1 | 11/2003 | Bower |
| 6,662,796 | B2 | 12/2003 | Cyr |
| 6,681,754 | B1 | 1/2004 | Angeloni |
| 6,684,871 | B1 | 2/2004 | Troncoso et al. |
| 6,688,296 | B1 | 2/2004 | Greywall |
| 6,739,321 | B1 | 5/2004 | Puchierz |
| 6,742,511 | B1 | 6/2004 | Remme |
| 6,776,149 | B1 | 8/2004 | Beeks |
| 6,782,881 | B2 | 8/2004 | Mizek |
| 6,792,932 | B2 | 8/2004 | Musacchia |
| 6,789,536 | B1 | 9/2004 | Summers |
| 6,796,039 | B2 | 9/2004 | Walbrink |
| 6,814,068 | B1 | 11/2004 | Troncoso, Jr. |
| 6,823,597 | B2 | 11/2004 | Larson |

(56) References Cited

U.S. PATENT DOCUMENTS

| | | | |
|---|---|---|---|
| 6,823,856 | B2 | 11/2004 | Rager |
| 6,839,994 | B2 | 1/2005 | Proctor |
| 6,895,676 | B1 | 5/2005 | Mendyk |
| 6,904,900 | B2 | 6/2005 | Gallops |
| 6,913,008 | B2 | 7/2005 | Simo |
| 6,915,791 | B2 | 7/2005 | Harwath |
| 6,920,870 | B2 | 7/2005 | Minica |
| 6,938,616 | B2 | 9/2005 | Walk |
| 6,948,488 | B2 | 9/2005 | Afshari |
| 7,100,591 | B2 | 9/2006 | Edgell |
| 7,121,037 | B2 | 10/2006 | Penney |
| 7,140,143 | B1 | 11/2006 | Ivey |
| 7,219,662 | B1 | 5/2007 | Henry |
| 7,278,216 | B2 | 10/2007 | Grace |
| 7,308,772 | B1 | 12/2007 | Millett |
| 7,311,099 | B2 | 12/2007 | Rager |
| 7,331,338 | B2 | 2/2008 | Mizek |
| 7,360,313 | B1 | 4/2008 | Hamm |
| 7,409,950 | B2 | 8/2008 | Ellig |
| 7,475,485 | B1 | 1/2009 | Hamm |
| D589,578 | S | 3/2009 | Choma |
| 7,520,083 | B2 | 4/2009 | Dextraze |
| 7,597,095 | B2 | 10/2009 | Grace |
| 7,634,990 | B1 | 12/2009 | Gartland |
| 7,681,566 | B2 | 3/2010 | Mertens |
| 7,717,103 | B2 | 5/2010 | Johnson |
| 7,748,371 | B1 | 7/2010 | Doty |
| 7,900,365 | B1 | 3/2011 | Johnson |
| 7,963,279 | B2 | 6/2011 | Harwath |
| 8,079,171 | B2 | 12/2011 | Barret |
| 8,240,075 | B1 | 8/2012 | Mullin |
| 8,333,180 | B2 | 12/2012 | Mizek |
| 8,434,464 | B1 | 5/2013 | Terzo |
| 8,448,341 | B2 | 5/2013 | Haney |
| 8,474,443 | B2 | 7/2013 | Geno |
| 8,528,140 | B1 | 9/2013 | Phillips |
| 8,544,457 | B1 | 10/2013 | Munsell |
| 8,596,253 | B2 | 12/2013 | Adams |
| 8,701,643 | B2 | 4/2014 | Ellig |
| 8,707,606 | B2 | 4/2014 | Hoel |
| 8,752,536 | B2 | 6/2014 | Sims |
| 8,960,174 | B2 | 2/2015 | Khoshnood |
| 8,967,131 | B2 | 3/2015 | Hunt |
| 9,004,054 | B2 | 4/2015 | Khoshnood |
| 9,032,944 | B2 | 5/2015 | Adams |
| 9,089,216 | B2 | 7/2015 | Liu |
| 9,151,567 | B1 | 10/2015 | Estridge |
| 9,341,433 | B1 | 5/2016 | Summers |
| 9,453,709 | B2 | 9/2016 | Hamm |
| 9,726,453 | B1 | 8/2017 | Hamm |
| 9,746,277 | B2 | 8/2017 | Khoshnood |
| 9,816,776 | B2 | 11/2017 | Ellig et al. |
| 9,909,839 | B1 | 3/2018 | Hamm |
| 9,933,229 | B2 | 4/2018 | Coalson et al. |
| 10,190,851 | B1 * | 1/2019 | Hamm ..... F41G 1/467 |
| 2002/0100177 | A1 | 8/2002 | Savage |
| 2003/0024516 | A1 | 2/2003 | Mizek |
| 2003/0056379 | A1 | 3/2003 | Johnson |
| 2005/0172945 | A1 | 8/2005 | Rager |
| 2005/0188972 | A1 | 9/2005 | Davis |
| 2006/0010759 | A1 | 1/2006 | Penney |
| 2006/0137670 | A1 | 6/2006 | Shaffer |
| 2006/0157038 | A1 | 7/2006 | Ellig |
| 2006/0162709 | A1 | 7/2006 | Roberts et al. |
| 2006/0179704 | A1 | 8/2006 | Dextraze |
| 2006/0201005 | A1 | 9/2006 | Lueck |
| 2006/0268433 | A1 | 11/2006 | Thomas |
| 2007/0163560 | A1 | 7/2007 | Mertens |
| 2008/0000463 | A1 | 1/2008 | Holmberg |
| 2008/0163503 | A1 | 7/2008 | Priebe |
| 2009/0307956 | A1 | 12/2009 | Barret |
| 2010/0162611 | A1 | 7/2010 | Samson |
| 2011/0168147 | A1 | 7/2011 | Schaffer |
| 2011/0271944 | A1 | 11/2011 | Haney |
| 2012/0138035 | A1 | 6/2012 | Ellig |
| 2012/0279107 | A1 | 11/2012 | Hoel |
| 2013/0255654 | A1 | 10/2013 | Nystrom |
| 2015/0075016 | A1 | 3/2015 | Wassmer |
| 2015/0184972 | A1 | 7/2015 | Grace et al. |
| 2016/0025456 | A1 | 1/2016 | Hamm |
| 2017/0191788 | A1 | 7/2017 | Eacker |
| 2018/0045488 | A1 | 2/2018 | Hamm |

FOREIGN PATENT DOCUMENTS

| | | |
|---|---|---|
| EP | 07696790 | 4/1997 |
| EP | 19960307576 | 4/1997 |
| WO | WO2007089579 | 8/2007 |

OTHER PUBLICATIONS http://www.hhasports.com/catalog/4/optimizer-lite/; website screenshot for the Optimizer Lite; Dec. 21, 2014.

http://www.hhasports.com/catalog/3/optimizer-lite-cadet/; website screenshot for the Optimizer Lite Cadet; Dec. 21, 2014.

http://www.hhasports.com/catalog/5/brushfire/; website screenshot for the Brushfire; Dec. 21, 2014.

http://www.hhasports.com/catalog/14/pro-series/; website screenshot for the Pro Series; Dec. 21, 2014.

website screenshot of Bowfinger Archery Inc. Medusa Max arrow rest at facebook.com; Apr. 21, 2015.

website screenshot of AAE D.O.A. arrow rest at facebook.com; Jun. 27, 2014.

Spot Hogg Catalog, 2011.

https://www.youtube.com/watch?v=jYPorUBPMow; YouTube video HHA Sports Optimizer Cadet Youth Archery Sight; captured Dec. 23, 2013.

"Review: Limb Driver Arrow Rest"; archeryreport.com; Mar. 30, 2010; https://web.archive.org/web/20100330091317/http://archeryreport.com/2010/03/review-limb-driver-arrow-rest/.

"Gear Review—Trophy Taker Smackdown Pro Arrow Rest"; Sole Adventure, soleadventure.com, Mar. 18, 2013; http://soleadventure.com/2013/03/gear-review-trophy-taker-smackdown-proarrow-rest/.

"UP*Draft Limb-Driven Drop-Away Arrow Rest"; TruGlo, truglo.com, Dec. 20, 2017; https://web.archive.org/web/20171220115745/http://www.truglo.com:80/archery-rests/up-draft-limb-driven-drop-away-arrow-rest.asp.

"Guide to Compound Bow Arrow Rests"; P.J. Reilly, Lancaster Archer Supply, lancasterarchery.com, Jun. 2, 2017; http://www.lancasterarchery.com/blog/guide-to-compound-bow-arrow-rests/.

"The Modern Compound Bow", LokMan Sung et al., Journal of forensic sciences 63.1 (2018): 130-139; https://onlinelibrary.wiley.com/doi/pdf/10.1111/1556-4029.13503.

"Hamskea Hybrid Hunter Pro Arrow Rest (Microtune)", Lancaster Archer Supply, lancasterarchery.com, accessed Jul. 18, 2017; http://www.lancasterarchery.com/hamskea-hybrid-hunter-pro-arrow-restmicrotune.html.

"Newest: AAE Pro Drop Rest: Limb or Cable Activated Fall-Away Rest"; bowhunting.net, Apr. 26, 2016; https://web.archive.org/web/20160923182309/http://www.bowhunting.net/2016/04/newest-aae-pro-drop-rest-limb-or-cable-activated-fall-away-rest/.

HHA Sports 2002 Archery Product Catalog.

* cited by examiner

WINDAGE MECHANISM

CROSS REFERENCE TO RELATED APPLICATION

This application claims the benefit of U.S. patent Ser. No. 10,190,851 issued on Jan. 29, 2019, the disclosure of which is hereby incorporated by reference herein in its entirety for all purposes

FIELD OF THE INVENTION

This invention relates generally to a sight for a firearm, bow or other similar type of weapon or equipment. More particularly, the present invention relates to a windage mechanism for a sight.

BACKGROUND

Adjustable sights, for example, those used in the field of archery, are known to be adjustable to account for many external factors, e.g. the distance to the target, wind, various axis, etc. Current sights typically use one of two types of windage mechanisms, a micro-drive or a macro-drive.

A first type of windage mechanism is a micro-drive. The micro-drive utilizes a threaded screw and knob. As the knob is turned a screw moves the sight pin(s) away from the frame of the sight or closer to it. A micro-drive is often beneficial for making minor adjustments or precise adjustments because a partial turn of a knob often equates to a small amount of movement to the sight pin(s). However, micro-drives are not as advantageous for making larger adjustments, such as when a sight is first attached to a weapon, and adjusted because it requires turning the knob many times which is inefficient and slow.

A second type of windage mechanism is a macro-drive. The macro-drive utilizes a clamp on a bar. When the clamp is loosened, the sight pin(s) may be moved, e.g. by moving the bar through the clamp, away from the frame of the sight or closer to it. When the sight pin(s) are in position, the clamp is tightened to hold the bar at the exact position. A macro-drive is often beneficial for making larger adjustments, such as when a sight is first attached to a weapon, and adjusted because the amount the bar is moved is often the same as the amount the sight pin(s) is moved. Further, the sight pin(s) can be moved from one end of movement to the other, or anywhere in between, in an instant. However, macro-drives are not advantageous for making small, precise or repeatable adjustments.

As such, there is a need for a windage mechanism that can make larger or smaller adjustments precisely and efficiently.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiment, and will be readily apparent to those skilled in the art. Such objects, features, benefits and advantages will be apparent from the above as taken in conjunction with the accompanying figures and all reasonable inferences to be drawn therefrom.

DETAILED DESCRIPTION

Figure 1:
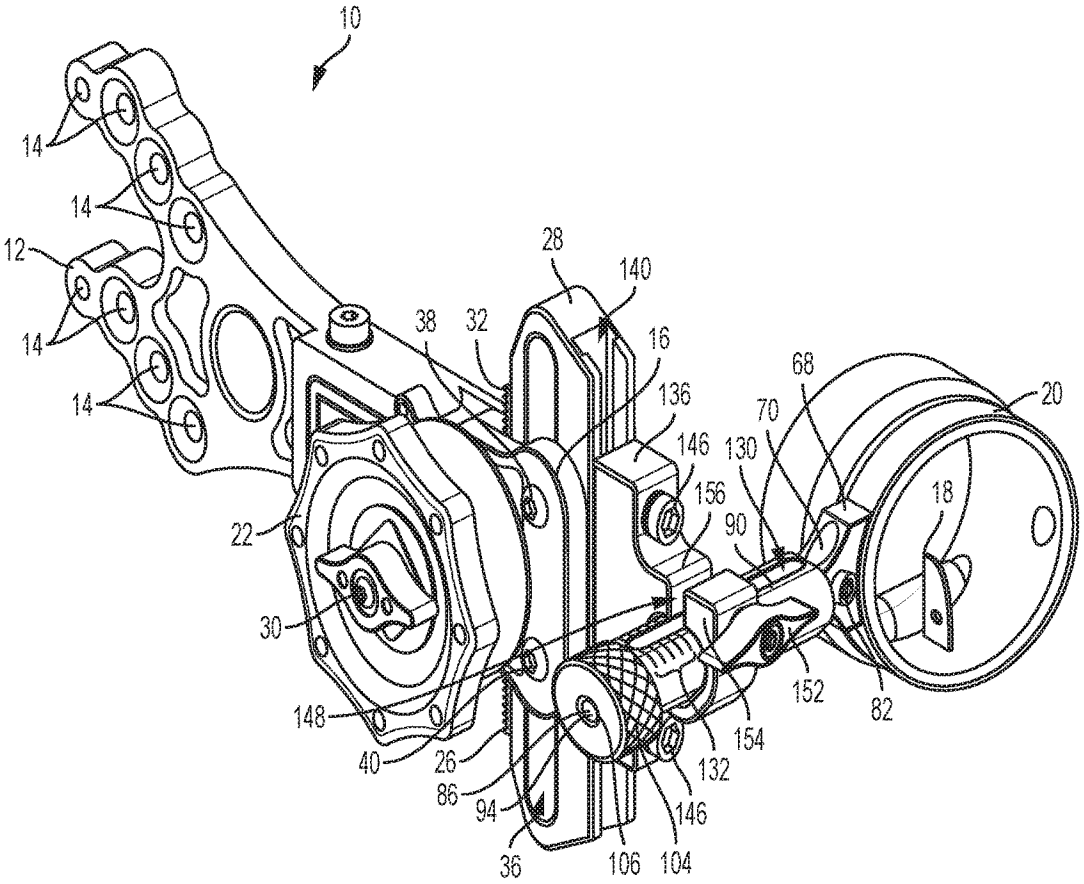
FIG. 1 is a perspective view of a sight apparatus.
Figure 2:
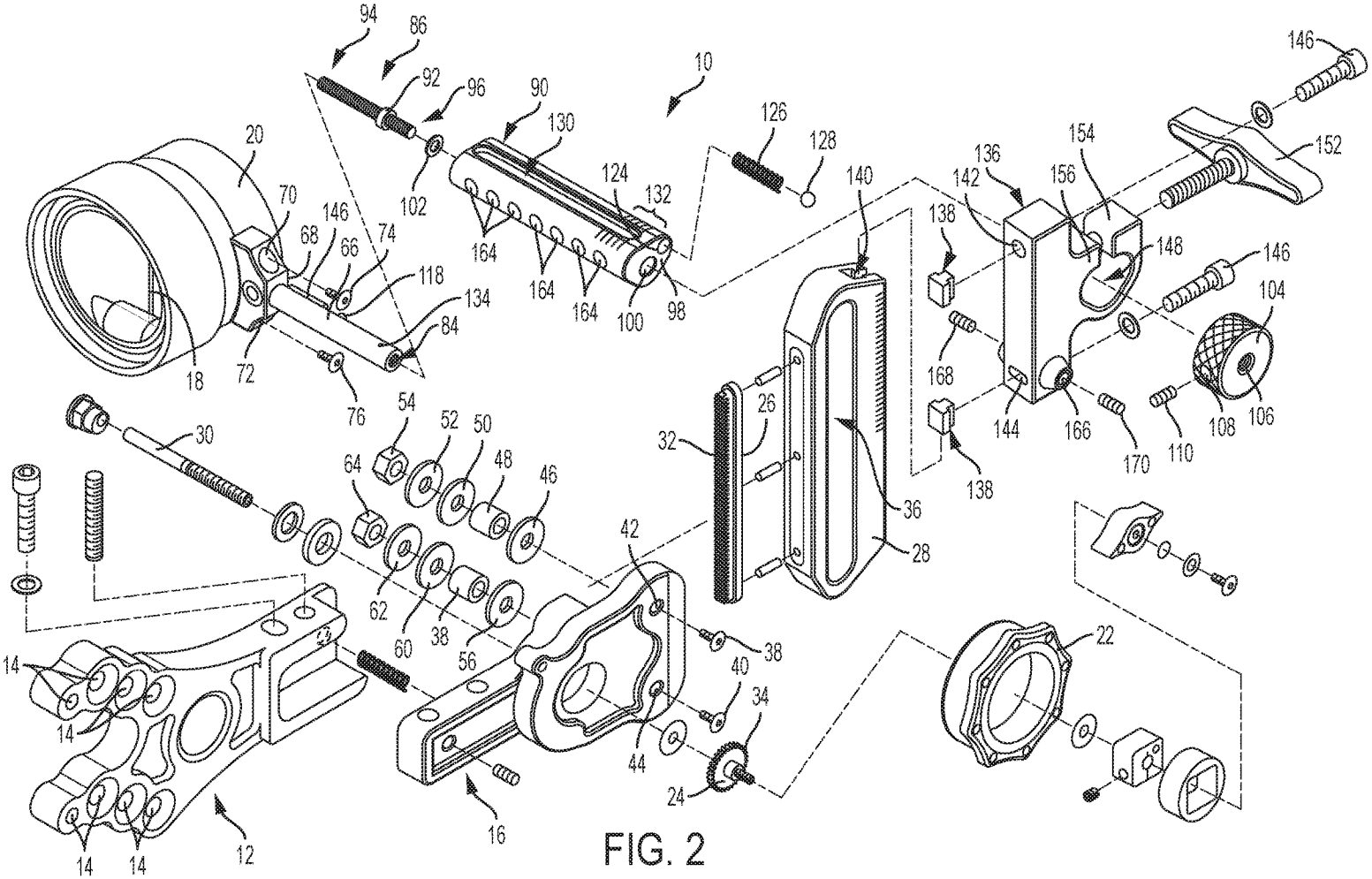
FIG. 2 is an exploded perspective view of the sight apparatus of FIG. 1.
Figure 3:
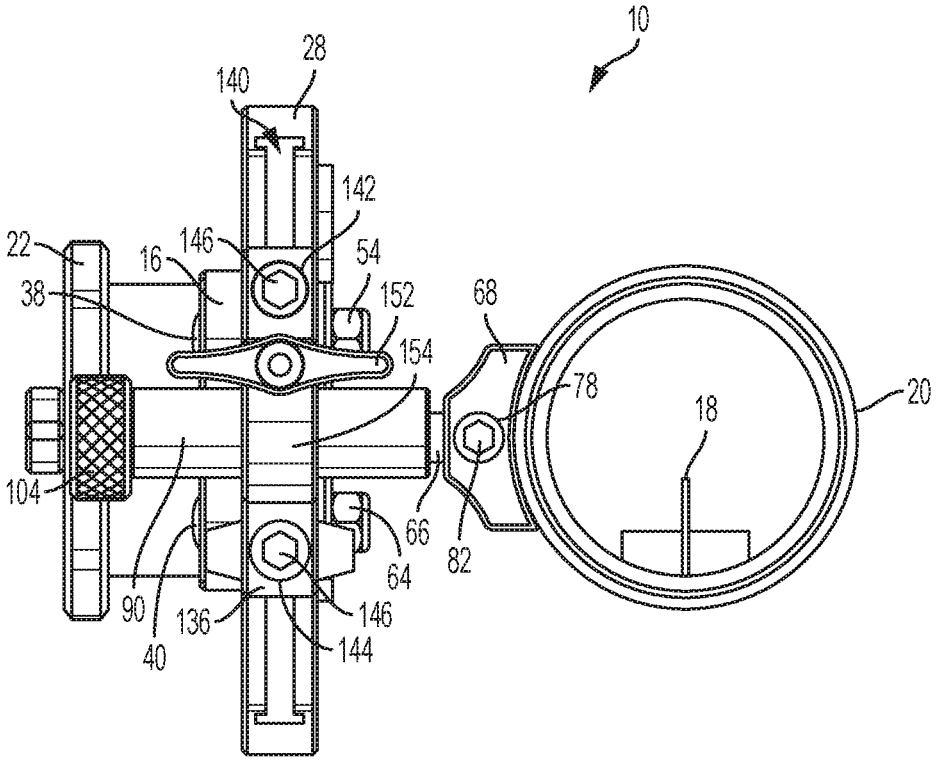
FIG. 3 is a front elevation view of the sight apparatus of FIG. 1.
Figure 4:
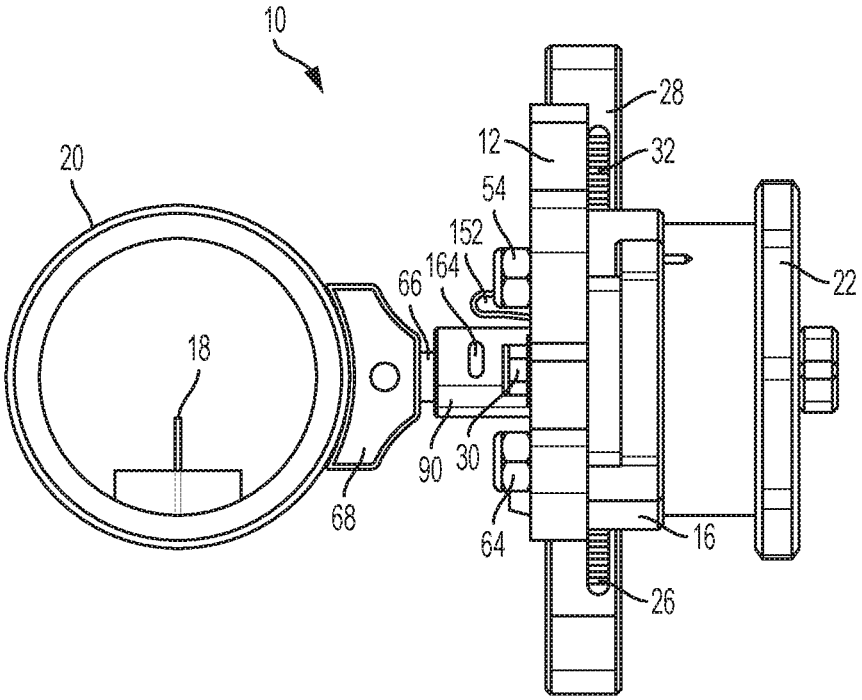
FIG. 4 is a rear elevation view of the sight apparatus of FIG. 1.

The sight apparatus 10, as shown in FIGS. 1-9, has a housing or frame that can include a number of members or portions, as seen in FIG. 2. One portion of the frame as best seen in FIG. 1, is a mounting member or bracket 12 which has a variety of mounting holes 14 that permit the sight apparatus 10 to be attached to a variety of firearms, weapons or equipment, in this example a bow, in a variety of positions. Another portion of the frame shown in FIG. 2 is an adjustable member or portion 16 that is adjustably connected to the mounting member 12. The frame could also be integrally formed or any number of the portions combined or integrally formed, e.g. slide member, block, arm, etc.

In the embodiment shown in FIGS. 1-9, the sight apparatus 10 includes a number of correction mechanisms, designed to permit the sight apparatus to be adjusted in a number of ways such that the sight may be very finely calibrated. Some equipment may not need such fine calibration and therefore, may not need as many or any such correction mechanisms. One such correction mechanism permits adjustment to the line of sight through a sight pin 18 attached to a sight mount or scope head 20 vertically, e.g. up or down. This type of adjustment is often referred to as elevation adjustment.

The embodiment seen in FIG. 2 includes the translation of rotation from a dial 22 engaged with or rotatably connected to the frame to linear, e.g. vertical, movement of the sight pin 18. One way to accomplish such translation is through a rack-and-pinion or drum-and-slide mechanism, such as that disclosed in U.S. patent application Ser. No. 14/873,917, owned by the Applicant and which is hereby incorporated by reference herein in its entirety for all purposes. The drum could be a circular or pinion gear 24 connected to the wheel 22, which pinion gear engages the linear gear bar or rack 26 of a slide member 28, the slide being connected to the sight pin 18 as discussed further below. The engagement between the drum 24 and slide member 28 causes the slide, and thereby the sight pin 18, to move up and down in response to rotation of the drum, e.g. by rotation of the dial or wheel 22.

In the embodiment shown in FIG. 2, the wheel 22, such as that disclosed in U.S. patent application Ser. No. 14/061,216, owned by the Applicant and which is hereby incorporated by reference herein in its entirety for all purposes, is attached to a gear 24. As seen most clearly in FIG. 2, the peg or pin 30 on which the wheel 22 resides and rotates about is secured to adjustable member 16.

As referenced above, the slide member 28 carries the rack gear, linear gear bar or vertical gear 26, which has a set of bar teeth 32 for engaging the pinion teeth 34 of the pinion gear 24. The slide member 28 is engaged with, e.g. slidably held to, a first part of the housing, in FIG. 2 the adjustment member 16. The slide member 28 can also have a groove 36 in which at least one fastener or, in the embodiment seen in FIG. 2, a first or top slide member fastener 38 and a second or bottom slide member fastener 40, extend.

One such correction mechanism permits adjustment to the line of sight through a sight pin 18 in a scope head 20 laterally, e.g. left or right when looking through the scope head. This type of adjustment is often referred to as windage adjustment. In the embodiment shown, the adjustment member 16 has a first or top adjustable member hole 42 and a second or bottom adjustable member hole 44. The top slide member fastener 38 extends through the top adjustable member hole 42, a first top washer 46 a top bushing 48, the groove 36, a second top washer 50, a third top washer 52 and into a top nut 54 to hold the slide member 28 to the adjustment member 16. A second or bottom slide member fastener 40 extends through the bottom adjustment member hole 44, a first bottom washer 56 and a bottom bushing 58, the slot 36, a second bottom washer 60 and a third bottom washer 62 and into a bottom nut 64. When the sight apparatus 10 is assembled, the two bushings 48, 58 are located in a vertical groove 36 formed in the slide member 28 and the washers 46, 50, 56, 60 will sandwich the slide member 28 as seen in FIG. 2.

The bushings 48, 58 and/or the washers 46, 50, 56, 60 can be made of a low friction material, such as Teflon, nylon, or other suitable plastic or low friction material. The use of a harder material, such as metal, for the third washers 52, 62 protects the washers 50, 60 from the nuts 54, 64. The sides of slide member 28 and/or the groove 36 could be made from a low friction material in addition or alternatively to the bushings 48, 58 and/or the washers 46, 50, 56, 60.

The scope head or sight mount 20 is attached to the slide member 28 such that as the slide member moves up or down in response to the rotation of the dial 22, the scope head also moves up and down to thereby selectively adjust the sight apparatus 10.

As can be seen in the embodiment shown in FIGS. 1-3 and 9, the scope head 20 has a post or stem 66 which is attached to the scope head by an adapter 68. In one embodiment the stem 68 is made from ground stainless steel for strength and to provide smooth movement within the boss 90. However, other materials could be used for the stem 66, e.g. aluminum, without defeating the spirit of the invention. The adapter 68 has a top adapter hole 70 and a bottom adapter hole 72 for the top adapter fastener 74 and bottom adapter fastener 76 respectively, that secure the adapter to the scope head 20. The adapter has a third adapter hole 78 that aligns with an side adapter hole 80 in the stem 66 such that a stem fastener 82 secures the stem to the adapter and, thereby, the scope head 20. The scope head 20 and the stem 66 could also be attached in a number of known means for attaching such components, e.g. integrally forming, welding, threading, gluing, etc., the use of which would not defeat the spirit of the invention.

The end of the stem 66 opposite the scope head 20 has an end hole 84. A worm gear 86 is threaded into the end hole 84 of the stem 66. The stem 66 and worm gear 86 fit within a first or boss bore 88 in a windage arm or boss 90 to attach the scope head 20 to the boss. The boss bore 88 terminates in a wall 98.

A collar 92 is affixed to the worm gear 86 to divide the worm gear into two parts, a first part 94 that is engaged with the stem 66 and a second part 96 opposite the first part. When the stem 66 and worm gear 86 are inserted into the boss bore 88, the collar 92 abuts the wall 98 of the boss 90 to hold the stem and/or worm gear to the boss and prevent the stem and/or worm gear from being further inserted into the boss bore 88. The second part 96 of the worm gear 86 extends out of the boss bore 88 through a smaller wall hole 100 in the wall 98 of the boss 90. A collar washer 102, such as a silicone or plastic washer, may be located between the wall 98 and the collar 92 to decrease the friction therebetween when the worm gear 86 and, thereby, the collar is rotated.

Figure 11:
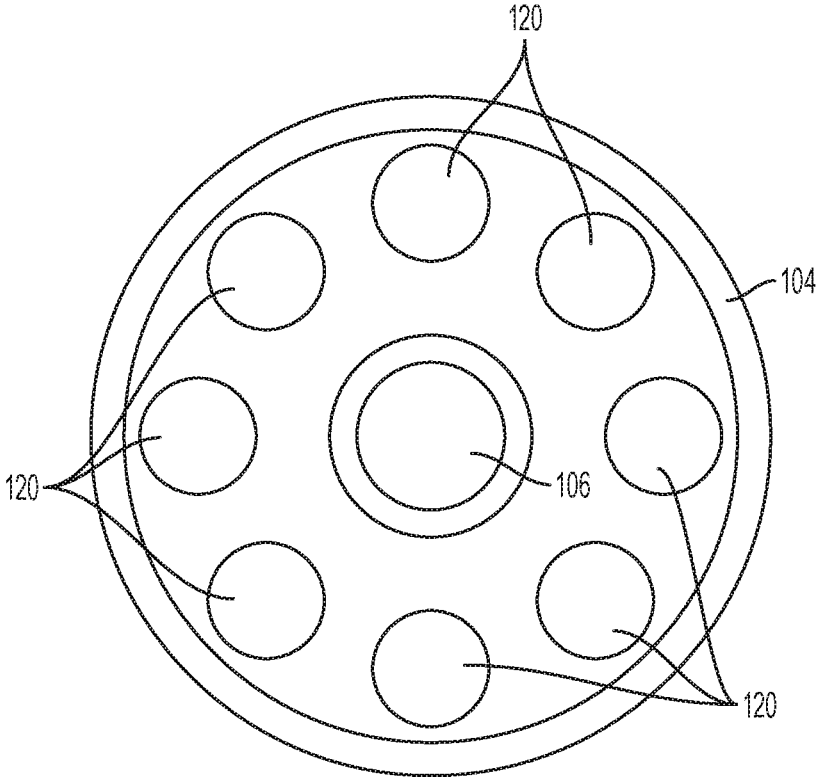
FIG. 11 is a side elevation view of the micro-knob removed from the sight apparatus of FIG. 1.

A micro-knob 104 is attached to the worm gear 86 to form a threaded portion thereof and rotatably attach the micro-knob to the boss 90, such that the micro-knob may be turned to laterally move the scope head 20 and sight pin 18. As such, the scope head 20 and sight pin 18 are engaged with the boss 90 and the micro-knob 104. The micro-knob 104 in FIG. 11 includes a center hole 106 sized to receive the second part 96 of the worm gear 86 extending through the wall hole 100 in the wall 98 of the boss 90. An edge hole 108 in the curved surface of the micro-knob 104 allows a an edge fastener 110 to be threaded into the edge hole to contact the second part 96 of the worm gear 86 and prevent the micro-knob from coming loose from the worm gear. The micro-knob 104 and the stem 66 could also be attached in a number of known means for attaching such components, e.g. integrally forming, welding, threading, gluing, etc., the use of which would not defeat the spirit of the invention.

Figure 9:
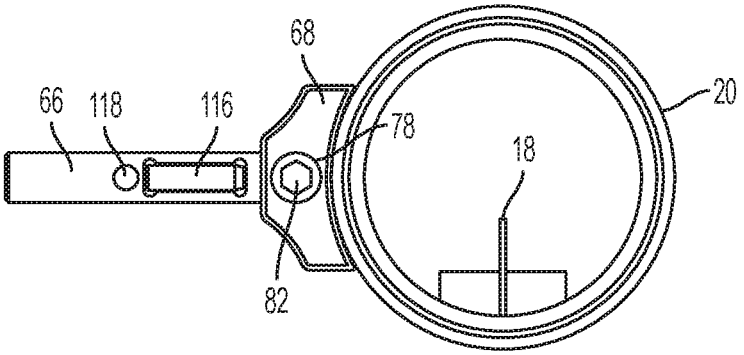
FIG. 9 is a front elevation view of the scope head removed from the sight apparatus of FIG. 1.

The stem 66 embodiment seen in FIG. 9 also includes a notch 112 and a divot 114. The notch 112 receives a bar 116 and the divot 114 receives a ball 118. The boss 90 has a second or overlapping bore 122 that overlaps the boss bore 88. The intersecting boss bore 88 and overlapping bore 122 receive the stem 66 and bar 116 and ball 118 such that the stem cannot be rotated within the boss bore. The stem 66 and the bar 116 could also be attached in a number of known means for attaching such components, e.g. integrally forming, over-molding, the use of which would not defeat the spirit of the invention.

When the micro-knob 104 is rotated in a first direction, the worm gear 86 is rotated in a first direction. Because the collar 92, on one side of the wall 98 of the boss 90, and the micro-knob 104, on the other side of the wall, hold the worm gear in place with respect to the boss, rotating the worm gear, e.g. by micro-knob 104, does not translate into movement of the worm gear in lateral direction. In one embodiment, the micro-knob 104 is larger than the wall hole 100 such that when the boss 90 is moved in a first lateral direction, the micro-knob will contact the wall 98 and the boss 90 will be prevented from being moved further in the first lateral direction. Because of the intersecting boss bore 88 and overlapping bore 122 and bar 116 and ball 118, the stem cannot rotate with the worm gear 86. Therefore, the first part 94 of the worm gear 86 is threaded further into the end hole 84 in the stem 66 when the micro-knob 104 is rotated in a first direction and unthreaded further out of the end hole in the stem when the knob is rotated in a second direction. When the first part 94 of the worm gear 86 is threaded into the end hole 84 in the stem 66, the stem moves laterally further into the boss 90 and the scope head 20 moves in a first lateral direction, e.g. toward the boss. When the first part 94 of the worm gear 86 is unthreaded out of the end hole 84 in the stem 66, the stem moves laterally further out of the boss 90 and the scope head 20 moves in a second lateral direction, e.g. away from the boss. Movement of the stem 66 within the boss 90 does not change the position of the boss with respect to the block 136.

Figure 10:
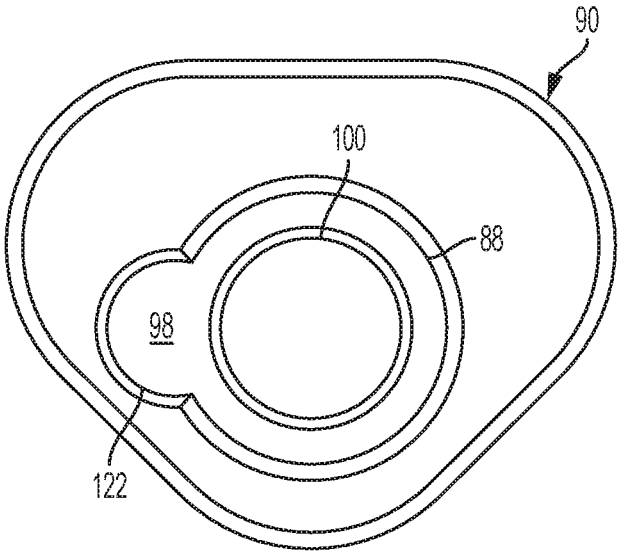
FIG. 10 is a side elevation view of the boss removed from the sight apparatus of FIG. 1.

The micro-knob 104 may also have a series of dents 120 in the flat surface of the micro-knob facing the wall 98 on the first end of the boss 90. The wall 98 of the boss 90 seen in one embodiment shown in FIG. 10, may have a boss blind bore 124in which a boss spring 126 and a boss ball bearing 128 are positioned, such that the boss spring urges the boss ball bearing at least partially out of the boss blind bore. When the micro-knob 104 is rotated the boss ball bearing 128 will move into and out of the dents 120 in the micro-knob to provide an audible sound, e.g. a click, and/or tactile feedback. The feedback provides a user with a reference as to how much movement or translation is being applied to the scope head 20 and/or provide a known amount of translation to get to desired scope head 20 position, e.g. five clicks.

The boss 90 may also have a gap 130 formed therein such that a portion of the stem 66, e.g. the marker 134, can be seen there-through. In the embodiment seen in FIG. 7, the boss 90 includes markings 132 by or proximate to the gap 130 and the stem 66 includes a marker 134 such that the amount of lateral movement of the stem and, thereby, the scope head 20 with respect to the boss can be seen visually or identified.

The boss 90 is attached to the slide member 28, by a clamp, block or windage bracket 136. In the embodiment seen in FIG. 2, the block 136 has a pair of T-nuts 138 that are configured, e.g. shaped, to be received in a channel 140 formed in the slide member 28 to attach the bracket to slide member. In the embodiment illustrated, the nuts 138 are T shaped as is the channel 140, however, there are many known shapes for nuts in cooperation with a channel that could be used without defeating the spirit of the invention.

The block 136 includes a top block hole 142 and a bottom block hole 144. A pair of block fasteners 146 extend through the top block hole 142 and a bottom block hole 144 and into the T-nuts 138. The T-nuts 138 are inserted into the channel 140, e.g. from the top or bottom. When the scope head 20 is in the desired position, the block fasteners 146 are tightened to hold the block 136 in place with respect to the slide member 28 by clamping a portion of the slide member between the T-nuts 138 and block.

Figure 5:
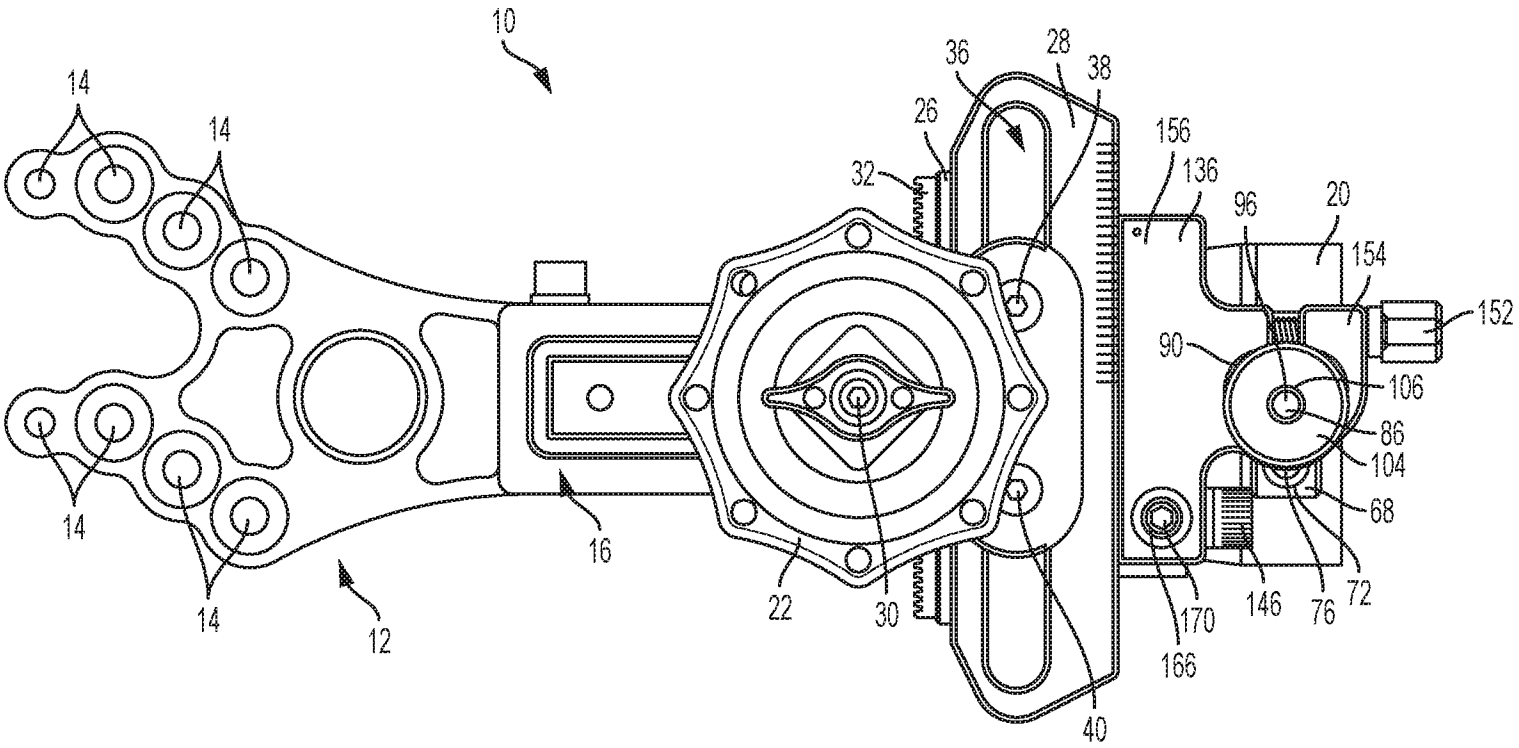
FIG. 5 is side elevation view of the sight apparatus of FIG. 1.
Figure 6:
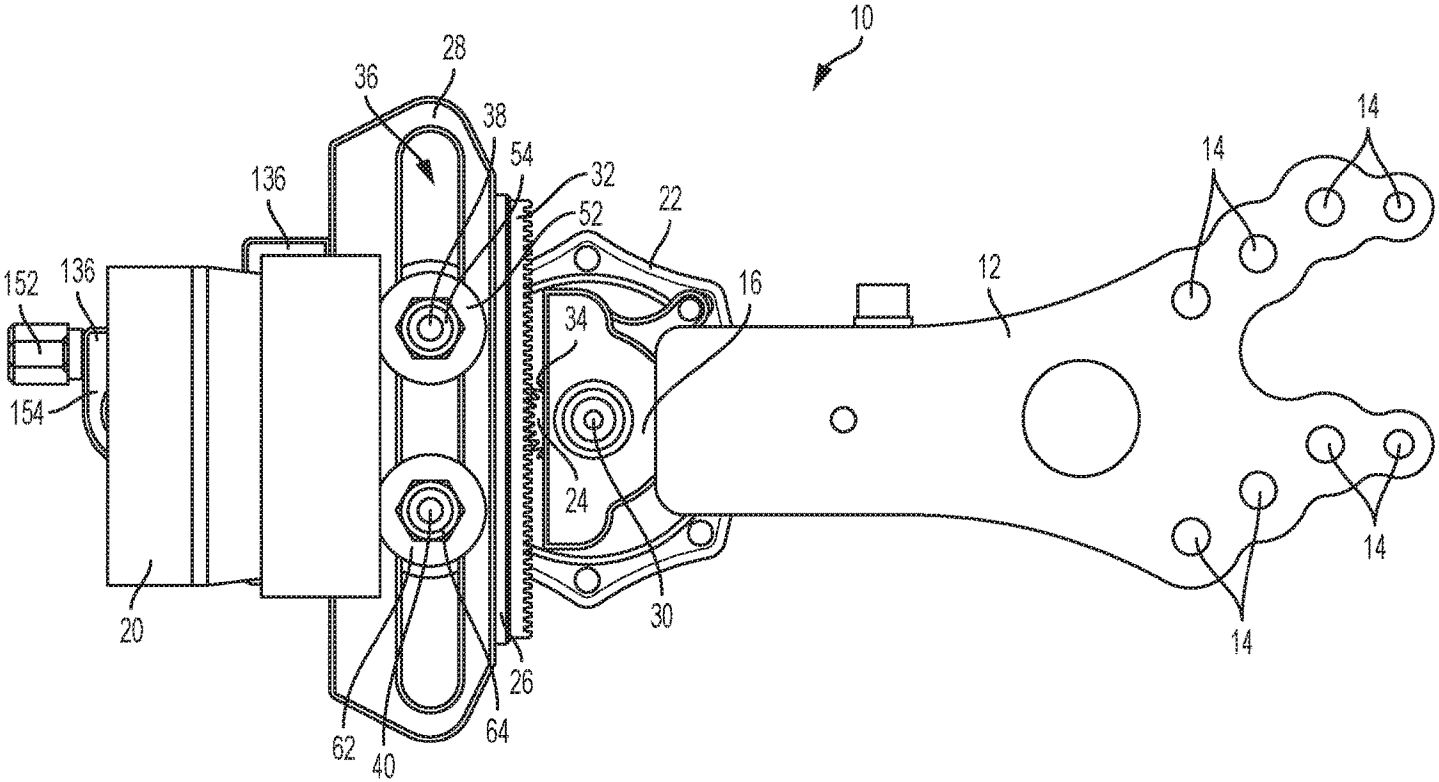
FIG. 6 is another side elevation view of the sight apparatus of FIG. 1.
Figure 7:
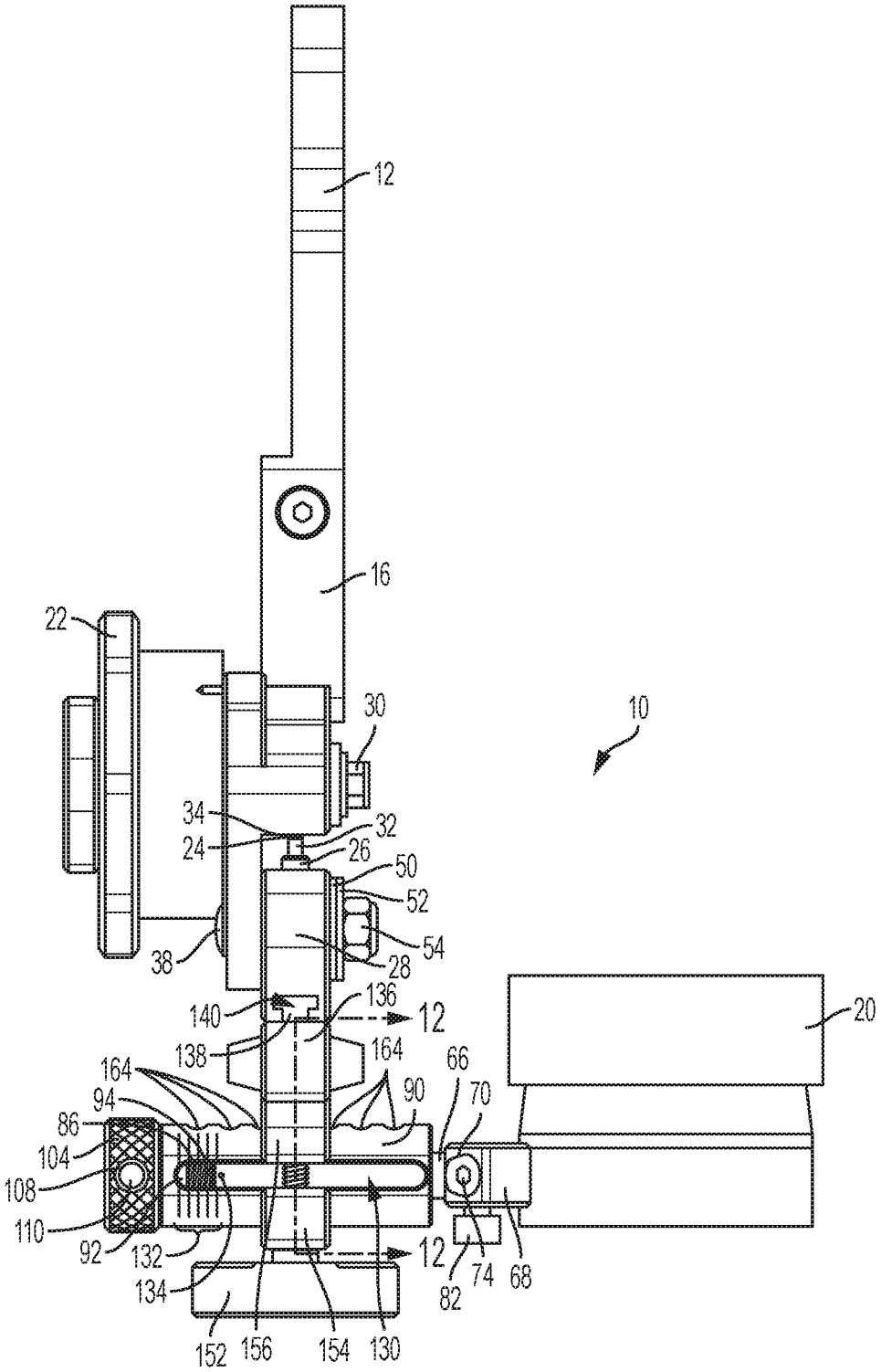
FIG. 7 is top plan view of the sight apparatus of FIG. 1.
Figure 8:
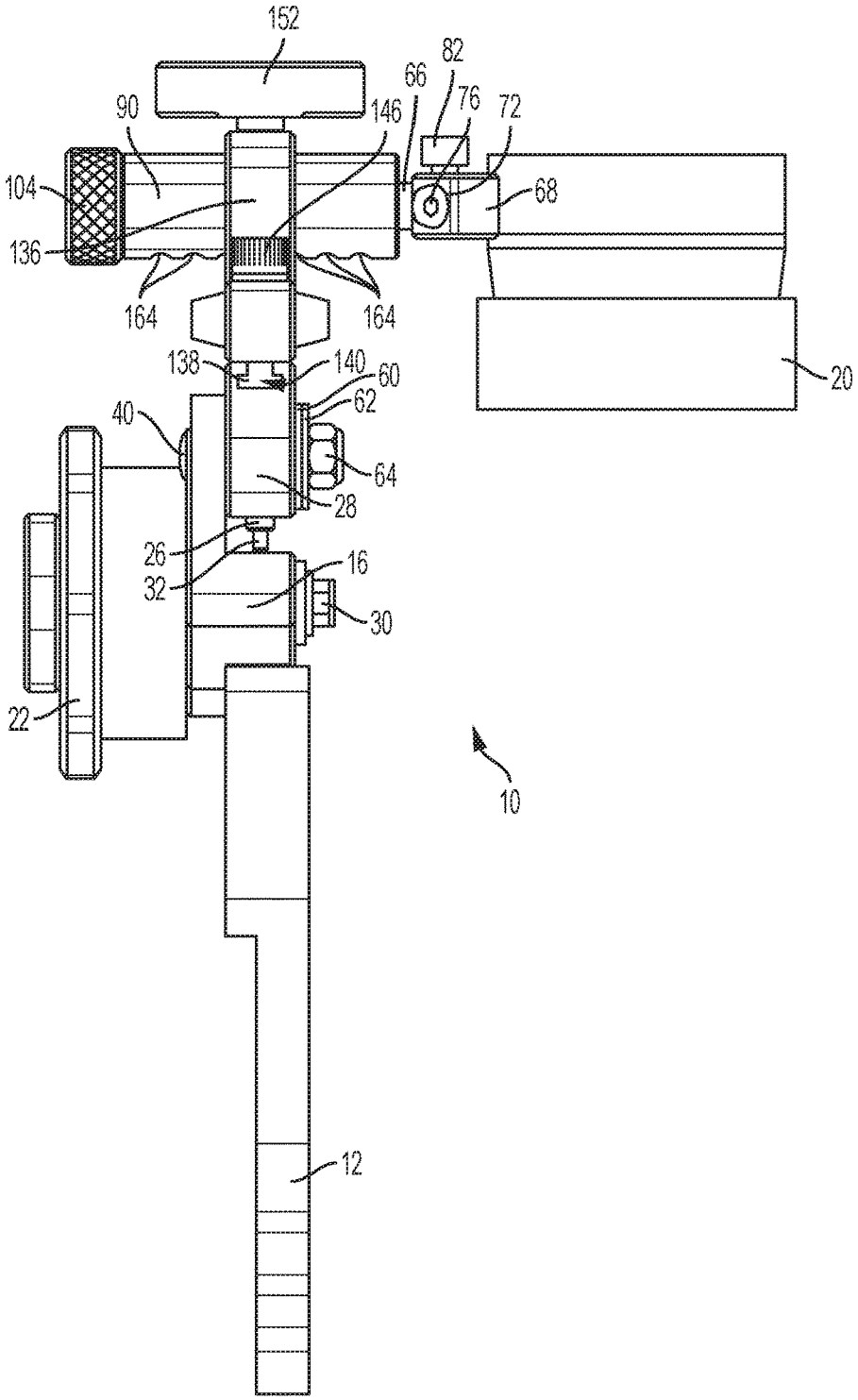
FIG. 8 is bottom plan view of the sight apparatus of FIG. 1.

Having a portion of the block 136 engage a channel 140 of the slide member 28 allows the block and, thereby, the scope head 20 almost infinite adjustment and placement vertically along the slide member. As seen in FIG. 5, the block 136 may also include a pointer and the slide member 28 a scale such that the desired location for the placement of the block along the channel 140 can be identified.

The block 136 also includes an opening 148, U-shaped in the embodiment show in FIG. 2, formed therein sized and shaped to slidably receive and selectively hold the boss 90. A leg hole 150 extends through the tops of a pair of legs 154, 156 forming the opening 148. A fastener, such as a lock or lock knob 152, is engaged with, e.g. threaded through, front leg or first part 154 and into the back leg or second part 156 of the block 136. When the lock knob 152 is tight or locked, e.g. further threading after the head or knob of the lock knob 152 contacts the front leg 154, the front leg will be bent towards the back leg 156 to clamp and/or lock the boss 90 into position and prevent the boss from moving with respect to the block 136. As seen in the embodiment in FIG. 1, the block 136 can be tightened and loosened by the archer's hand or fingers, without the use of tools, e.g. by using lock knob 152.

The boss 90 can also be designed such that the walls of the boss and/or size of the gap 130 allow the clamping action from the front leg 154 and back leg 156 to transfer to the front and back walls of the boss to clamp and hold the stem 66. Holes in objects are often very slightly larger than the object that is designed to fit in the hole, such as, for example, to permit the object to be inserted into the hole with little force and/or due to tolerances in machining. However, this allows the object to move while in the hole, if even slightly, often referred to as "play." To prevent the stem 66 and, thereby, the scope head 20 from rotating when the worm gear 86 is rotated by the micro-knob 104, a bar 116 is seated in a notch in the stem. In one embodiment, the bar 116 is made from ground stainless steel. However, other materials, e.g. aluminum, could be used without defeating the spirit of the invention. The stem 66 is inserted into the boss bore 88 and the bar fits in the overlapping bore 122 much like a key. A ball 118, made from a compressible material, e.g. acetal homopolymer resin, is seated in a divot 114 in the stem and is inserted into the overlapping bore 122 when the stem 66 is inserted into the boss bore 88. In order to reduce the play between the stem 66 and the boss 90, the ball 118 is sized slightly larger than the overlapping bore 122 such that it is compressed or squeezed slightly to fit in the overlapping bore. Making the ball 118 from a compressible material allows the ball to be squeezed into the overlapping bore 122 and compress to permit the clamping action from the front leg 154 and back leg 156 to transfer to the front and back walls of the boss to clamp and hold the stem 66.

Figure 12:
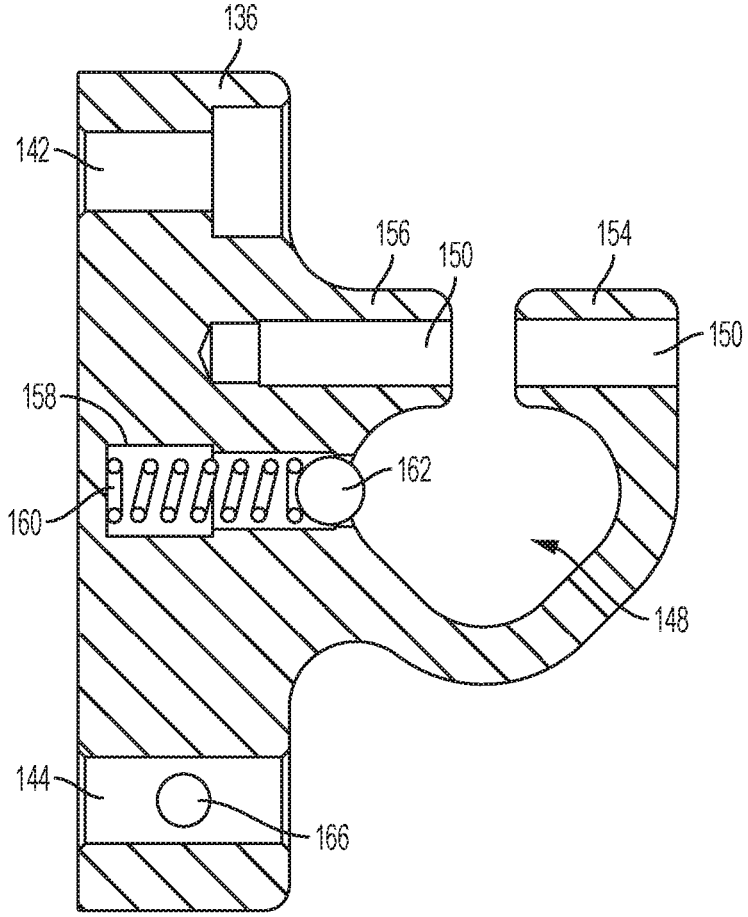
FIG. 12 is a front cross-sectional view of the sight apparatus taken along the lines 12-12 in FIG. 7.

A portion of the block 136, in the embodiment shown in FIG. 12 the back leg 156, may also include a block bore 158 sized to receive a block spring 160 and a block ball bearing 162. The block spring 160 is positioned in the bore 158 to urge the block ball bearing 162 at least partially into the opening 148 in which boss 90 is positioned. In the embodiment shown in FIG. 2, the front face of the boss 90 also includes a series of indentations 164. As the boss 90 is moved within the block 136, and, thereby, the indentations 164, the boss will make a clicking sound and feel as the block spring 160 pushes or urges the block ball bearing 162 into and/or out of one of the indentations. These clicks may be correlated to units of displacements, e.g. one click equals sixes inches at twenty yards and/or so many divots. In one embodiment one rotation of the micro-knob 104 moves the scope head 20 a first distance which is less than movement of the boss from one indentation to another or the second distance. In another embodiment, eight rotations of the micro-knob 104 results in movement of the scope head 20 about the same as movement of the boss from one indentation to another. The ball bearing 162 being within one of the series of indentations 164 also helps selectively hold the boss 90 in position with respect to the block 136 such that the micro-knob 104 can be rotated to move the scope head 20.

The sight pin 18, via the scope head 20, can be adjusted or moved laterally on a larger scale by loosening the lock knob 152 which permits the boss 90 to be slid within the opening 148 of the block 136. Moving the boss 90 within the block 136 does not change the position of the stem 66 within the bore 88 in the boss. When the sight pin 18 is generally in the desired position, e.g. when first setting up the sight 10, the lock knob 152 can be tightened to hold the boss 90 in position. The micro-knob 104 can be used to adjust or move the sight pin laterally on a smaller scale by turning the micro-knob. This invention allows the scope head 20 to be adjusted in the large increments quicker than with just a micro-drive and in small increments with more precision than with just a macro-drive.

One of the top block hole 142 and bottom block hole 144 can be a slotted hole, seen as the bottom block hole in the embodiment illustrated in FIG. 2. When the block fastener 146 for the slotted hole 144 is loosened, the bottom of the block 136 can be rotated about a pivot or axis through the block fastener 146 in the top block hole 142 in the block, sometimes called the second axis. This rotation allows the scope head 20 to be adjusted and leveled.

To assist in allowing very small adjustments in the second axis, a side block hole 166 is located in the block 136 on each side of the slotted hole 144. Threaded inserts, e.g. a threaded insert on the scope head or left side 168 and a threaded insert on the dial or right side 170, are engaged in the side block holes 166. To adjust the scope head 20, for example, the right insert 170 can be loosened and the left insert 168 threaded into the left side block hole 166 until it contacts the bottom block fastener 146. Further rotation of the left insert 168 into the left side block hole 166, e.g. clockwise, will cause the block 136, and thereby the scope head 20, to rotate counterclockwise, when looking through the scope head 20, about the top block fastener 146. When the desired position of the scope head 20 is reached, the block fasteners 146 can be tightened down and the left insert 168 and right insert 170 put into contact with the bottom block fastener 146 to secure the scope head, as seen best in FIG. 2.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein. For example, in one embodiment many components are made from aluminum, however, other suitable materials known in the art could be used without defeating the spirit of the invention.

What is claimed is:

1. A sight comprising:

a frame having an opening formed therein;

a boss, wherein a portion of the boss is positioned within the opening and selectively held by the frame;

a knob rotatably attached to a first end of the boss; and a sight pin engaged with the boss and the knob; wherein movement of the boss within the frame moves the sight pin laterally;

wherein rotation of the knob moves the sight pin laterally; and wherein when the knob is rotated, the boss is not moved.

2. The sight of claim 1 further comprising a lock engaged with the frame such that when the lock is tightened, the frame clamps the boss to hold the boss in position with respect to the frame.

3. The sight of claim 1 wherein the opening is a U-shaped opening and a lock is engaged with a pair of legs of the frame forming the opening such that when the lock is tightened, the pair of legs clamp the boss to hold the boss in position with respect to the frame.

4. The sight of claim 1 further comprising:

a sight pin mount having a stem, wherein the sight pin is attached to the sight pin mount;

wherein the knob is in threading engagement with the stem such that when the knob is rotated in a first direction the sight pin moves in first lateral direction; and when the knob is rotated in a second direction the sight pin moves in second lateral direction.

5. The sight of claim 4 wherein the stem includes a bar;

wherein the boss includes a second bore that overlaps with the first bore; and wherein when the stem is located in the first bore, the bar is located in the second bore.

6. The sight of claim 5:

wherein a divot is formed in the stem;

wherein a compressible ball is seated in the divot;

wherein when the stem is located in the first bore, the ball is located in the second bore; and wherein the ball is sized slightly larger than the second bore such that the ball is compressed when located in the second bore.

7. The sight of claim 4 further comprising a lock engaged with the frame;

wherein when the lock is tightened, the frame clamps the boss to hold the boss in position with respect to the frame; and wherein when the lock is tightened, a clamping action from the frame is transferred to the boss such that the boss clamps the stem to hold the stem in position with respect to the boss.

8. A sight comprising:

a housing;

a dial rotatably connected to the housing;

a slide member engaged with the housing, the slide member configured to move in a vertical direction when the dial is rotated;

a bracket attached to the slide member, the bracket having a pair of legs forming an opening;

an arm selectively and slidably received in the opening;

a scope head attached to the arm;

a lock knob engaged with the pair of legs; and a micro-knob engaged with the scope head;

wherein when the lock knob is tight, the arm is prevented from moving laterally within the bracket by the pair of legs and when the lock knob is loose, the arm is permitted to move laterally within the bracket; and wherein when the micro-knob is rotated in a first direction, the scope head is moved in a first direction and when the micro-knob is rotated in a second direction, the scope head is moved in a second direction.

9. The sight of claim 8 further comprising a spring and ball positioned within a bore formed in an end of the arm and wherein the micro-knob has a series of dents such that as the micro-knob is rotated, the ball will be urged into and out of the dents.

10. The sight of claim 8 wherein the scope head has a post, the post having a marker;

wherein the post is located at least partially with in a bore of the arm;

wherein the arm has a gap formed therein such that the marker is visible through the gap and the post has markings proximate to the gap; and wherein when an amount the scope head is moved laterally is identified by the marker in relation to the markings.

11. The sight of claim 8 further comprising:

a pair of fasteners that extend through holes formed in the bracket; and a pair of nuts, each of the pair of nuts attached to an end of one of the pair of fasteners;

wherein the pair of nuts are configured to be received in a channel formed in the slide member; and wherein when the pair of fasteners are tight, the pair of nuts hold the slide member to the bracket to hold the bracket in a desired position with respect to the slide member.

12. The sight of claim 11 wherein the pair of nuts and channel are T-shaped.

13. The sight of claim 8 wherein the micro-knob is larger than the opening such that when the arm is moved in a first lateral direction and the micro-knob contacts the arm, the arm cannot be moved further in the first lateral direction.

14. A sight comprising:

a frame;

a dial rotatably connected to the frame;

a sight mount engaged with the frame such that rotation of the dial causes the sight mount to move vertically;

an arm engaged with the sight mount;

a clamp attached to the frame, the clamp configured to be tightened by hand; and a micro-knob in threaded engagement with the sight mount;

wherein at least a portion of the arm is positioned in the clamp such that when the clamp is tight, the sight mount cannot be moved laterally and when the clamp is not tight, the sight mount can be moved laterally; and wherein rotation of the micro-knob causes the sight mount to move laterally.

15. The sight of claim 14, wherein the sight mount has a post and the micro-knob is in threaded engagement with the sight mount through a worm gear attached to the micro-knob and post.

16. The sight of claim 14, wherein rotation of the micro-knob causes lateral movement of the post.

17. The sight of claim 16, wherein when the arm is moved laterally within the clamp, the position of the post with respect to the arm does not change.

18. The sight of claim 17, wherein when the post is moved laterally, the position of the arm with respect to the clamp does not change.

19. A sight having a sight mount and windage bracket attached to a frame, the windage bracket comprising:

a block with an opening formed therein, the block configured to attach the windage bracket to the frame;

a boss positioned within the opening and selectively held by the block;

a knob rotatably engaged with the boss;

a stem engaged with the knob and configured to be attached to the sight mount;

wherein when the knob is rotated in a first rotational direction, the stem is moved in a first lateral direction;

wherein movement of the boss in the first lateral direction within the block does not result in movement of the stem with respect to the boss; and wherein rotation of the knob does not result in movement of the boss within the block.

* * * * *